United States Patent [19]

Barre

[11] 4,228,910

[45] Oct. 21, 1980

[54] DEVICE FOR TIGHTLY STOPPING A BOTTLE

[76] Inventor: René E. L. Barre, 39, boulevard Bourdon, Paris, France

[21] Appl. No.: 952,285

[22] Filed: Oct. 18, 1978

[30] Foreign Application Priority Data

Jul. 19, 1978 [FR] France ..... 78 21447

[51] Int. Cl.[3] ..... B65D 39/00

[52] U.S. Cl. ..... 215/364

[58] Field of Search ..... 215/355, 364

[56] References Cited

U.S. PATENT DOCUMENTS

| | | | |
|---|---|---|---|
| 1,989,218 | 1/1935 | Villanyi | 215/364 |
| 3,599,820 | 8/1971 | Lee | 215/364 |
| 4,108,325 | 8/1978 | Barré | 215/364 |

FOREIGN PATENT DOCUMENTS

| | | | |
|---|---|---|---|
| 1479255 | 3/1967 | France | 215/364 |

*Primary Examiner*—Donald F. Norton

*Attorney, Agent, or Firm*—Woodard, Weikart, Emhardt & Naughton

[57] ABSTRACT

This invention concerns an improved device for tightly stopping a bottle which comprises a stopper whose body is provided with at least one neck receiving a flexible airtight or watertight sealing ring, this neck having at least one toothed surface and at least one smooth surface, the smooth surface being formed at the bottom of an annular groove bounded by edges of its sides.

3 Claims, 1 Drawing Figure

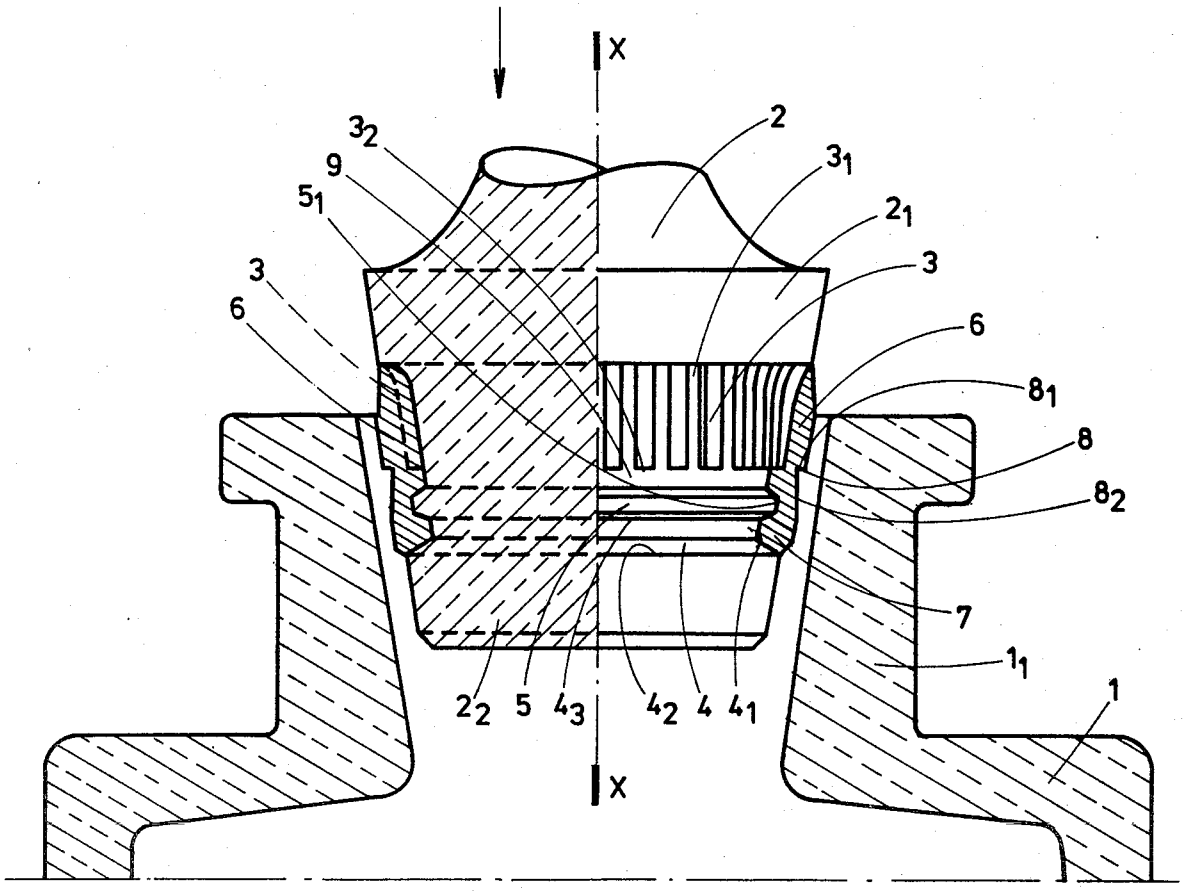
1
$1_1$
7
$8_2$
8
$8_1$
6
3
$2_1$
$3_1$
2
$4_1$
4
$4_2$
$4_3$
5
$2_2$
X
X
$3_2$
9
$5_1$
3
6

DEVICE FOR TIGHTLY STOPPING A BOTTLE

BACKGROUND OF THE INVENTION

The invention relates to an improved device for tightly stopping a bottle.

This improved device for tightly stopping a bottle comprises a stopper whose body is provided with at least one neck receiving a flexible airtight or watertight sealing ring, this neck having at least one toothed surface and at least one smooth surface, the device being characterised in that the smooth surface is formed at the bottom of an annular groove bounded by edges on each of its sides.

In accordance with another feature of the invention at least one of the sides of the groove is formed by the edge of a rib associated with the bottom of the neck.

In accordance with another feature of the invention the flexible airtight or watertight sealing ring has on its outside face at least one annular groove.

In accordance with another feature of the invention the annular groove on the outside face of the flexible ring is shaped, in cross-section, in the form of a saw tooth.

SUMMARY OF THE INVENTION

A stopping device for tightly stopping a bottle according to one embodiment of the present invention comprises a stopper having a body portion provided with at least one neck receiving a flexible fluid-tight sealing ring, the neck having at least one toothed surface and at least one smooth surface, the stopping device being designed and arranged such that the smooth surface is formed at the bottom of an annular groove bounded by edges on each of its sides.

Consequently one object of the present invention is the production of a stopping device which will be perfectly airtight or watertight and whose airtightness or watertightness does not deteriorate even after a great number of opening and closing operations of the bottle.

This result is obtained in accordance with the invention by providing, on the body of the stopper, a packing or a ring of flexible material, this body and this packing being formed in such a manner that the packing has a annular zone of compression whose outside periphery is perfectly circular in order to assure airtightness or watertightness, this zone of compression constituting moreover a retaining organ which avoids movement of the packing axially in relation to the stopper during the opening and closing operations, the combination of these two details ensuring the reliability of the stopper.

BRIEF DESCRIPTION OF THE DRAWING

The drawing is a side elevation view, partly in cross section, of a stopping device according to a typical embodiment of the present invention.

DESCRIPTION OF THE PREFERRED EMBODIMENT

Referring to the drawing, there is shown a bottle 1 of which the stopper 2 has a casing or body $2_1$ of conical shape, the shape and dimensions of this body corresponding to those of the opening of the neck $1_1$ of the bottle.

Like the prior art, the body of the stopper has an annular neck in which is formed, preferably by moulding, a ring 6 of flexible material, preferably a plastic material.

At one part of the bottom of this neck are formed teeth 3 in the form of castellations of triangular or other form, these teeth extending axially. The object of these teeth is essentially to avoid rotation of the plastic packing material during the opening and closing operations of the bottle, this contributing to the good airtightness or watertightness of the stopper.

The bottom of this neck essentially comprises, like the prior art, an annular zone whose essential object is to obtain a ring of plastic material whose exterior periphery is perfectly cylindrical at the level of this annular part, this being difficult to achieve at the level of the toothed part of the neck for the reason that, at the time of solidification of the plastic material, the contraction is different at the deepest part of the neck and at the highest part of the neck, this tending to form, at the level of the teeth, a packing whose external surface is faceted.

In accordance with the invention the smooth surface of the neck is constituted by the bottom $4_1$ of a groove 4 which is bounded on each of its sides by the edges $4_2$ and $4_3$.

In the illustrated example the bottom $4_1$ of the groove constitutes the smooth surface and has a conicity or taper corresponding to the conicity or taper of the body $2_1$ of the stopper 2 while the edges $4_2$ and $4_3$ of this groove are slanting in order to form a groove which widens towards the periphery of the body.

Also, in the illustrated example, the edge $4_2$ of the groove 4 is formed by one side of the neck whilst the other edge $4_3$ is formed by one side of a rib 5 whose height is less than the depth of the neck at that point.

One will understand that this construction ensures that the smooth surface $4_1$ at the bottom of the neck 4 is separated by the rib 5 from the zone of the teeth 3 so that the ring of flexible material 6, which is moulded by casting in the neck, will be held, on the one hand, in a lateral direction by the teeth 3 and on the other hand, in axial directions, by the edges $4_2$ and $4_3$ of the groove 4. There is formed, at 7 on the ring 6, a zone of compression whose outer surface is perfectly circular (having the smooth surface $4_1$ opposite it), this zone of compression being delimited in the axial direction of the body by the edges $4_2$ and $4_3$ of the groove 4 in order to prevent the zone of compression being displaced and to limit the elastic effect of the material of the ring 6 in the axial direction of the body.

In the illustrated example the depth of the groove 4 is the same as the depth of the teeth, this being so because the bottom $4_1$ of the groove is an extension of the bottom $3_1$ of the toothed zone, and the upper surface $5_1$ of the rib is an extension of the upper edges of the teeth 3.

This arrangement allows ease of manufacture of the stopper and of the ring but, if desired, any other possible form could be adopted depending on the dimensions of the stopper body, of the neck and of the material employed for the formation of the ring 6.

As shown in the drawing, the ring 6 has on its external face an annular groove 8 which is for the purpose of further reducing the effects of compression of the material constituting this packing, in the axial direction and therefore better delimiting the zone of compression 7, and thus permitting injection moulding of the ring 6 without surface irregularities, derived from the injection orifice, being situated at the level of the most outer periphery of the packing which constitutes the part which is active in ensuring airtightness or watertightness. Thus, the opening of the injection orifice or orifices will be at the level of the bottom of the groove 8.

In the illustrated example, this annular groove 8 is formed, in cross-section, in the form of a saw tooth of which one of the sides $8_1$ is substantially perpendicular to the axis X-X of the stopper and of which the other $8_2$ side is substantially parallel to this axis and extends towards the base of the stopper.

The steep side $8_1$ of this groove 8 is situated substantially level with the edges $3_2$ of the teeth 3 which are separated from the rib 5 by a smooth base surface of the neck surface.

It will be noted likewise that, in the illustrated example, the flexible sealing ring 6 only occupies part of the height of the body $2_1$ of the stopper 2. Nevertheless, this flexible ring 6 can be extended over the whole height of the body and likewise can cover the base $2_2$ of the stopper, when this flexible ring would form a type of cup.

Likewise, the toothed surface 3 and the smooth surface 4 could be placed completely separately on the body of the stopper, the essential characteristic being that the parts of the flexible ring of plastic material 6 which are embedded in the toothed surface and in the smooth surface 4 are formed integrally.

What is claimed is:

1. An improved stopping device for tightly stopping a bottle comprising a stopper having a body portion provided with at least one neck receiving a flexible fluid-tight sealing ring, the neck having at least one toothed surface and at least one smooth surface, the stopping device being designed and arranged such that the smooth surface is formed at the bottom of an annular groove bounded by two edges, one edge on each side of said annular groove, one of the sides of said groove being constituted by the edge of a rib formed in the bottom of the neck and the depth of said groove corresponding to the depth of the base of said toothed surface.

2. The stopping device of claim 1 wherein the rib is separated from the toothed surface by a smooth surface.

3. The stopping device of claim 1 wherein the edges of the groove are slanted.

* * * * *